United States Patent [19]

Mongeon

[11] 4,402,521

[45] Sep. 6, 1983

[54] ROLLER SKATE PLATE ASSEMBLY WITH FLOATING AXLES

[76] Inventor: Douglas R. Mongeon, 2328 N. Maplewood, Orange, Calif. 92665

[21] Appl. No.: 198,306

[22] Filed: Oct. 20, 1980

[51] Int. Cl.[3] ..... A63C 1/24

[52] U.S. Cl. ..... 280/11.23; 280/11.28

[58] Field of Search ..... 280/11.28, 11.23, 11.27, 280/11.19, 11.26, 11.25, 7.13, 11.1 R, 11.1 BT, 87.04 A; 301/5.7

[56] References Cited

U.S. PATENT DOCUMENTS

| | | | |
|---|---|---|---|
| 457,129 | 8/1891 | Masterson | 280/11.28 X |
| 875,165 | 12/1907 | Faust et al. | 280/11.28 X |
| 899,963 | 9/1908 | Ferguson | 280/11.2 |
| 983,970 | 2/1911 | Zamboni | 280/11.27 |
| 2,430,533 | 11/1947 | Reich | 280/11.28 |
| 2,676,812 | 4/1954 | Owsen et al. | 280/11.28 |
| 3,895,844 | 7/1975 | Merbler | 301/5.7 |
| 4,076,265 | 2/1978 | Eash | 280/11.27 X |
| 4,090,283 | 5/1978 | Wooley | 301/5.7 X |
| 4,155,565 | 5/1979 | de Caussin et al. | 280/11.19 X |

FOREIGN PATENT DOCUMENTS

| | | | |
|---|---|---|---|
| 52982 | 4/1912 | Austria | 280/11.23 |
| 211859 | 1/1941 | Switzerland | 280/11.25 |

*Primary Examiner*—David M. Mitchell
*Assistant Examiner*—Pierre Huggins
*Attorney, Agent, or Firm*—Poms, Smith, Lande & Rose

[57] ABSTRACT

A roller skate plate is shown which includes a plate mounted against the sole of a boot and a slotted platform that receives a pair of C-shaped leaf springs within the slot. A pair of pivot posts mount within the slot to adjustably secure the C-shaped springs. Each pivot post includes a housing having a longitudinal bore which receives a helical spring or elastomeric plug to support a pivot plunger. The pivot plunger includes a spherical ball which engages a spherical socket within a pivot cap. The pivot cap passes through an aperture in the end of each C-shaped spring which functions to retain the cap and plunger within the housing. Skate axles are attached between the ends of the C-shaped leaf springs.

29 Claims, 8 Drawing Figures

ROLLER SKATE PLATE ASSEMBLY WITH FLOATING AXLES

The present invention relates to a roller skate plate and, more particularly, to a skate plate which mounts a pair of axles upon a leaf spring which, in turn, is supported on a resiliently mounted pivot to permit the axles to float up and down while rotating about the pivot.

BACKGROUND OF THE INVENTION

It is well known that roller skates include plates that support a pair of axles which mount four wheels. These plates may be clamped upon a shoe or boot by adjustable clamping means using roller skate keys for the adjustment or, in more expensive skates, may be bolted or otherwise secured directly to a boot.

In the late 1960's and early 70's, skateboards became popular due, in part, to the development of urethane coated wheels which functioned to absorb the irregularities of rough street pavement. The urethane wheel was then introduced to roller skates which also enjoyed a substantial increase in popularity.

With the development of urethane wheels, it becomes possible to improve the apparatus which supports the axles to which the wheels are mounted. That is, with the urethane functioning to absorb irregularities in the pavement or other surface over which the wheels are riding, it is possible to provide a finely tuned, spring loaded mounting apparatus for the skate axles which permits these axles to float. This provides the user of the skates with more freedom of movement than prior art roller skate plates even where those prior art plates are provided with some form of spring mechanism.

SUMMARY OF THE INVENTION

Accordingly, it is an object of the present invention to provide a spring mounting arrangement for the axles of a roller skate which permits the axles to float with greater freedom than prior art skate mounting arrangements.

It is another object to provide a roller skate plate assembly which is lighter than previous skates, simpler in design and more economical to manufacture.

A still further object of the present invention is to provide a roller skate plate assembly which is designed to optimize the advantages of urethane skate wheels.

In accomplishing these objects, the present invention utilizes two sets of interdependent spring systems including a first set of leaf springs and a second set of resilient members. The leaf springs of first set are C-shaped and each attached at one end to a plate which mounts upon the sole of a skate boot by a pivot housing which houses the second set of resilient members within a longitudinal bore of the housing. A pivotal plunger fits within each housing against the urging of the resilient member. The pivot plunger engages the second end of each C-shaped leaf spring and is retained within the housing by the spring action thereof.

Each axle of the roller skate is attached to the C-shaped spring before the second end which attaches to the pivot plunger. In this manner, the axles may move up and down against the urging of the C-shaped leaf springs and the resilient members. Further, the axles may roll or rotate about the pivots formed by the pivot plungers. This freedom permits each axle to float upon the plate thus permitting the user of a roller skate incorporating the skate plate assembly to enjoy a freedom of movement not found in previous skates.

DESCRIPTION OF THE DRAWINGS

For a better understanding of the present invention summarized above and of the object and advantages presented thereby, the reader's attention is directed to the following specification and accompanying drawings, wherein.

DESCRIPTION OF THE PREFERRED EMBODIMENT

Figure 1:
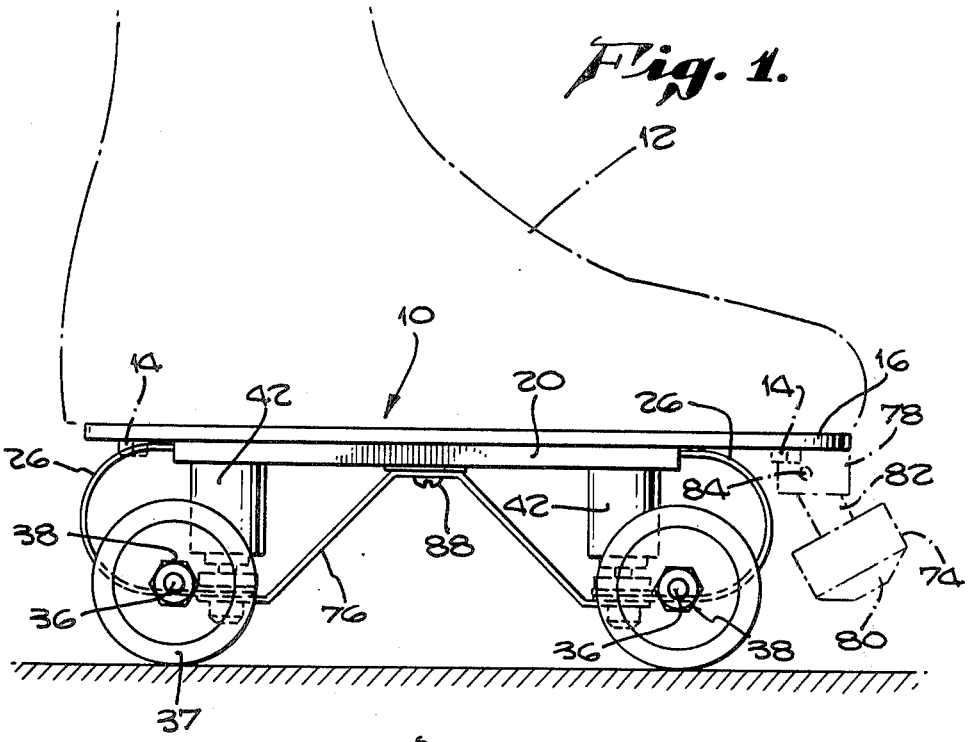
FIG. 1 is a side view of a typical skating boot showing a roller skate plate assembly of the present invention attached thereto with skate wheels mounted upon the plate assembly.

Referring now to the drawings, FIG. 1 shows a roller skate plate assembly 10 to which is attached a suitable boot 12, as by nuts 14 and bolts, not shown. The roller skate plate assembly 10 includes a boot plate 16 which comprises a generally flat steel plate having four apertures 18, FIG. 3, which receive bolts and nuts 14 for attachment to the boot sole. A spring mounting platform 20 extends from the surface of plate 16 as an integral part thereof. In another embodiment, the platform 20 could be attached as a separate part to the boot plate 16 by screws, not shown. The boot plate 16 is generally longer and wider than its spring mounting platform 20 and, for most boots, is configured to fit smoothly about the heel of the boot while extending almost to the toe thereof. The long, narrow spring mounting platform 20 is provided with a longitudinal slot 22, FIG. 2, which may be approximately 0.4 inches wide. Slot 22 is then further relieved at 24 to form a T-slot approximately 0.8 inches wide, FIGS. 4 and 5.

Figure 2:
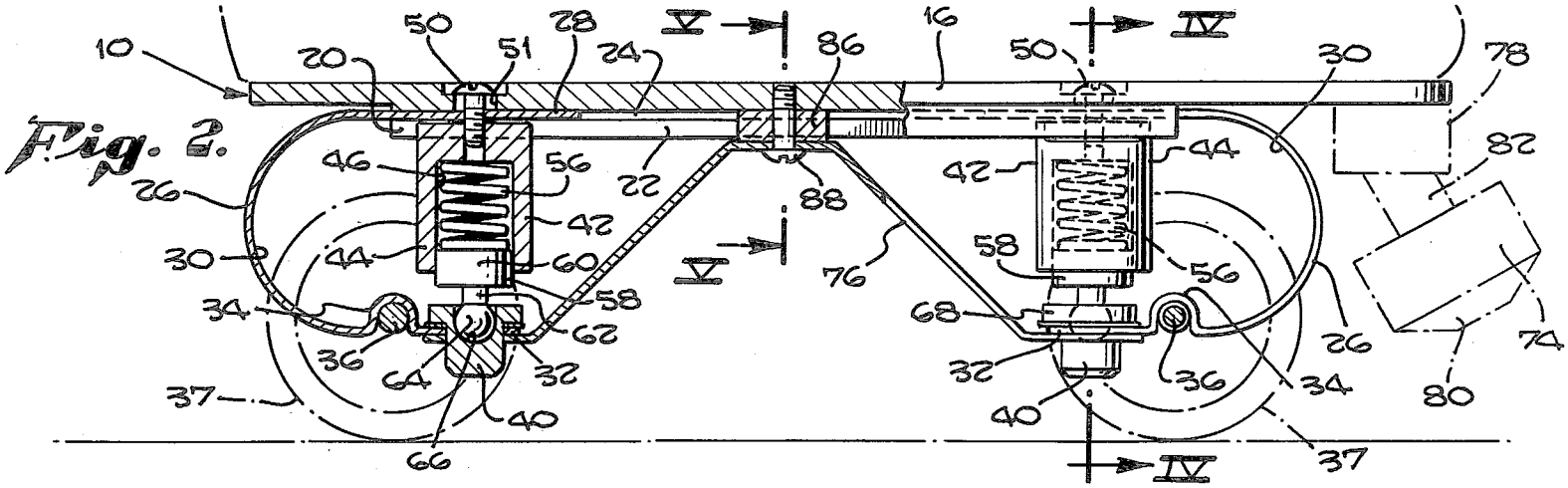
FIG. 2 is a side view, partially in section, showing the skate plate assembly.
Figure 3:
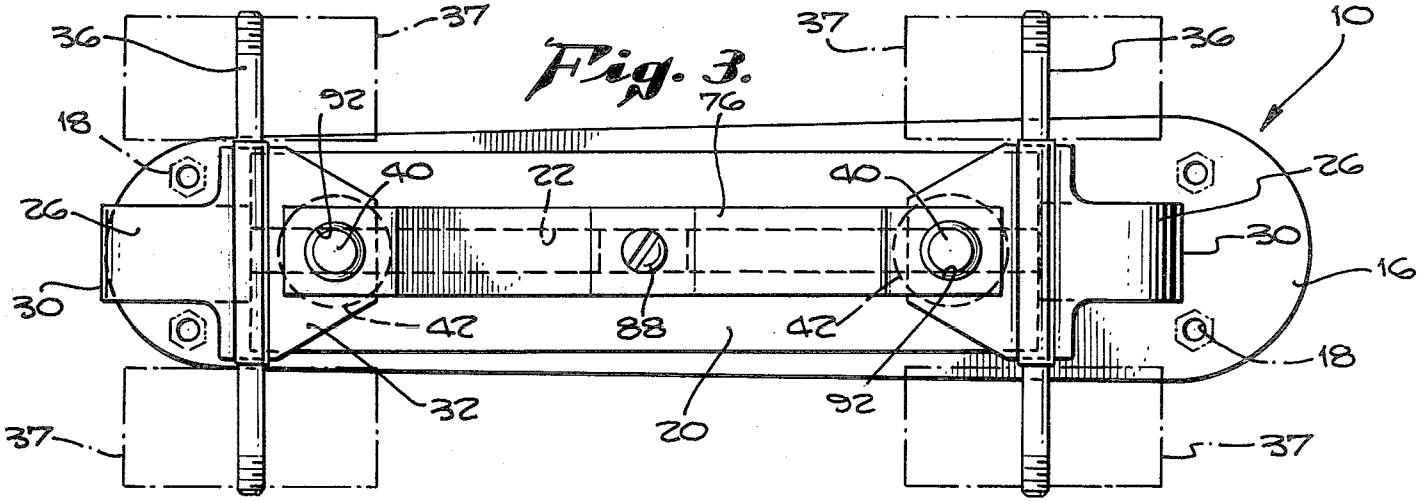
FIG. 3 shows a bottom view of the skate plate assembly.

The T-shaped slot 24 receives a C-shaped leaf spring 26 at each end. Each leaf spring 26 is designed to have a width slightly less than the width of the relieved T-shaped slot 24 so that it slides smoothly into that slot and is retained therein by the shoulders formed by slot 22. In the preferred embodiment, the leaf spring is manufactured from 0.063 inch thick 1095 high carbon steel. As best seen in FIGS. 2 and 3, the C-shaped leaf spring includes a first end with a generally flat, extended portion 28 that slides into the slot 24. Beyond the flat 28, the leaf spring 26 is curved in a semicircle 30 to join a second end of the leaf spring 32 which is parallel to the first end 28. Between the end of the second termination 32 of leaf spring 26 and the curved portion 30 is a relieved portion 34 whose generally semicircular configuration receives an axle 36 threaded at each end to receive urethane coated skate wheels 37. Each axle 36 is attached to the steel springs 26, as by copper brazing, while the wheels 37 are attached to the axle 36 by nuts 38.

The present invention lends itself to mechanical fabrication in that the springs 26 may be fabricated into a flat, one piece unit with the two semicircular reliefs 34. Shafts 36 are then placed into the reliefs 34 and brazed thereto. The springs may then be annealed, normalized and cut to the desired length. Thereafter, the springs may be bent and heat treated to the desired spring constant.

It will be seen from FIG. 3 that the second end 32 of spring 26 is widened to form a triangularly shaped ending which lengthens each relief 34 to further support the axles 36. The triangularly shaped end 32 of spring 26 is provided with an aperture 39 which receives a pivot cap 40 of a pivot post assembly 42.

Figure 4:
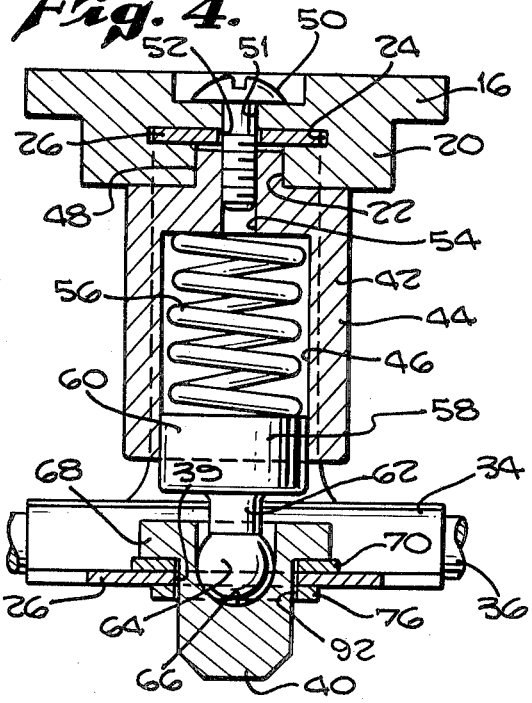
FIG. 4 is a detailed cross-sectional view taken along line IV—IV of FIG. 2, showing a pivot housing assembly.

Th pivot post assembly 42 includes a post housing 44, best seen in FIG. 4, having a longitudinal bore 46 extending partially there through. The upper most end of the housing 44 is relieved by flats 48 which permits the cylindrical surface of the housing 44 to fit between the sides of slot 22. The flats 48 thus prevent rotation of the housing 44. A mounting screw 50 passes through a suitably slotted aperture 51 within plate 16 and platform 20 and through an aperture 52 in spring 26 to engage a threaded aperture 54 within the top of housing 44. In this manner, the single screw 50 mounts the housing 44 to the plate 16 and, in turn, mounts spring 26 within the T-shaped slot 24.

Figure 7:
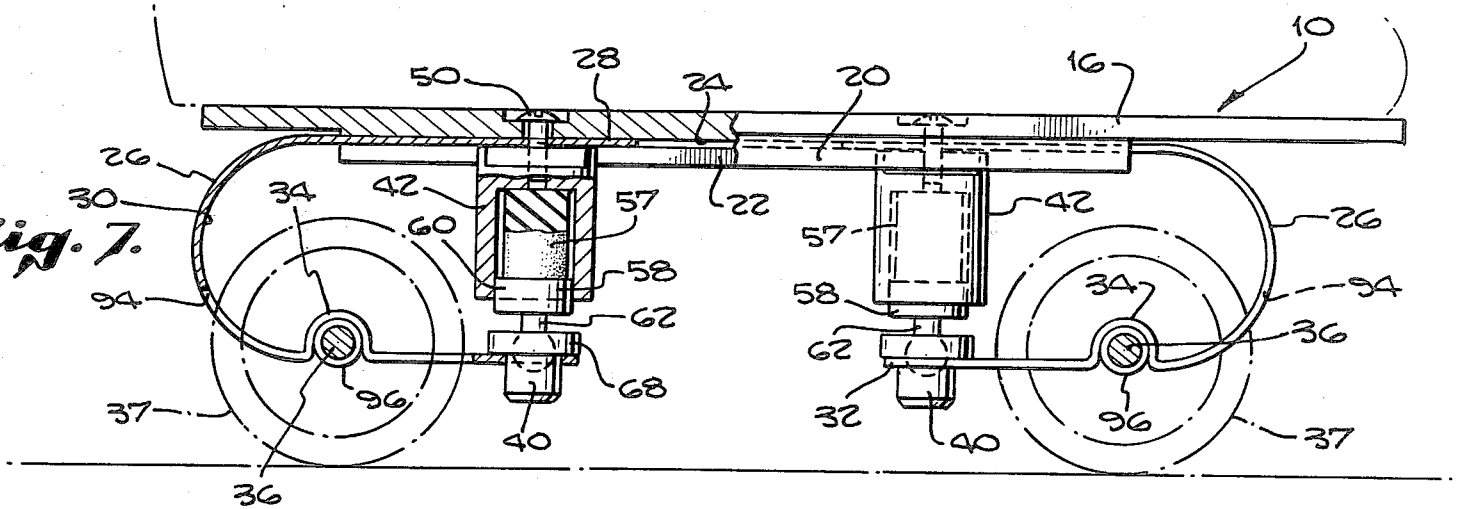
FIG. 7 is a side view, similar to FIG. 2, showing another embodiment of the present invention.

Longitudinal bore 46 receives a resilient member, such as a helical spring 56, FIGS. 2 and 4, or a plug 57 of elastomeric material, FIG. 7, which has an outer diameter slightly less than the inner diameter of bore 46 to permit its compression. Mounted under the spring 56 or elastomeric plug 57 is a pivot piston 58 having a upper plunger portion 60 whose outer diameter also slidably fits within the bore 46. The lower portion of pivot piston 58 includes a neck 62 and a spherical ball portion 64. The spherical ball 64 of the pivot piston 58 fits into a upper spherical socket 66 within the pivot cap 40. The outer surface of the cap 40 has an extended shoulder 68 which abuts the inner surface of the C-shaped leaf spring 26 at the spring end 32, FIG. 2.

It may now be seen that loosening of the screw 50 permits the spring 26, pivot post assembly 42, and the axle 36, mounted upon the spring 26, to be slid forward or backward within the slots 22–24, found in platform 20. In most roller skates, the rear axle is centered under the wearer's ankle whereas the front axle is centered under the ball of the wearer's foot. However, for long distance skating, the front axle may be moved forward; while, for trick skating, the front axle may be moved backwards. Further, as the user of the roller skate plate assembly grows and changes his or her boot size, it is possible to adjust the roller skate plate of the present invention without the necessity of purchasing new and larger plates.

Figure 6:
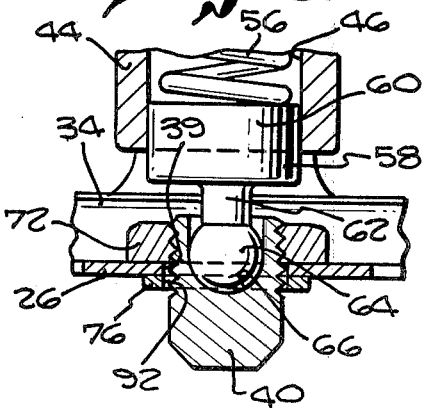
FIG. 6 is a detailed cross-section similar to FIG. 4, showing a second embodiment of the pivot housing assembly.

It will also be noted, with reference to FIG. 4, that the compression of helical spring 56 may be increased by the addition of toroidally shaped washers 70 between the shoulder 68 and spring 26. A second embodiment which utilizes a threaded pivot cap 40 and a keeper 72 is shown in FIG. 6. Here, rotation of the keeper 72 adjusts the pressure in the C-shaped leaf spring 26 thus increases or decreases its pressure upon the spring 56. For heavier skaters, the spring 56 may be replaced by a stronger spring or the elastomeric plug 57.

The roller skate plate assembly as described, provides freedom of movement in a vertical direction along the axis of the bore 46. This permits the axles 36 to move up and down under the urging of springs 26 and resilient member 56 or 57. Should an individual wearer jump and land heavily upon the urethane wheels 37, it will be seen that the shoulder 68 or keeper 72 will bottom against the lower surface of the housing 44 thus preventing further compression of springs 56 or plugs 57 or deflection of springs 26.

The spherical socket 66 which rides upon the spherical ball 64 of pivot piston 58 permits the axle 36 to roll about that pivot point. It will be apparent that the flat, C-shaped leaf spring 26 will return the axle 36 to its desired center position after such a roll. While the roll described is generally a rolling action about an axis perpendicular to the axle 36 and parallel to the plate 16, it will be seen that the configuration of the spring 26 and the pivot point formed by spherical ball 64 and spherical socket 66 will permit a twist of the axle 36 about an axis which passes through the center of the axle 36 perpendicular to the plane of the plate 16. From the foregoing, it becomes apparent that the unique mounting arrangement of the roller skate plate assembly 10 permits the axle 36 to float, thus providing a greater freedom to the wheels 37 then previously available in prior art skates.

Should the wearer of the roller skate plate assembly 10 wish to engage in quick stops or jumps, the skate plate assembly 10 of the present invention may be easily adapted to mount an optional stop 74 or an optional jump strap 76 as seen in FIGS. 1 and 3. The stop 74 consists of a housing 78 attached to plate 16, as by screws, not shown. A standard stop 74 having an elastomeric tip 80 and a mounting post 82 is inserted into an aperture in housing 78 wherein a pin 84 retains the post 82 and the stop 74.

Figure 5:
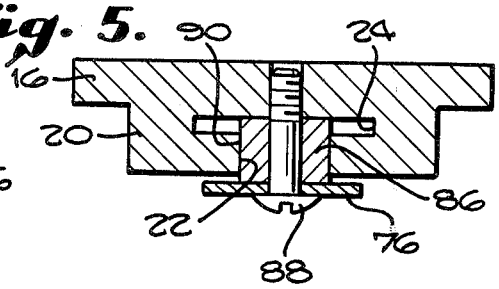
FIG. 5 is a detailed cross-sectional view taken along line V—V of FIG. 2.

The jump strap 76 consists of a post 86, FIG. 5, which is secured into a threaded aperture in plate 16 by a screw 88 which passes through the jump strap 76. The post 86 may be provided with flats 90 which prevents the turning of the post in a manner similar to the flats 48 and housing 44. The jump strap 76 includes a pair of arms extending at an angle from the post 86 over the pivot caps 40. The ends of the arms of the jump strap 76 are provided with apertures 92 which slidably retain the pivot caps 40 in the position shown. It will be seen that the jump strap prevents energy stored within springs 26 and 56 from being released too quickly by a jump which could cause the pivot piston 58 to be freed from its housing 44.

Figure 8:
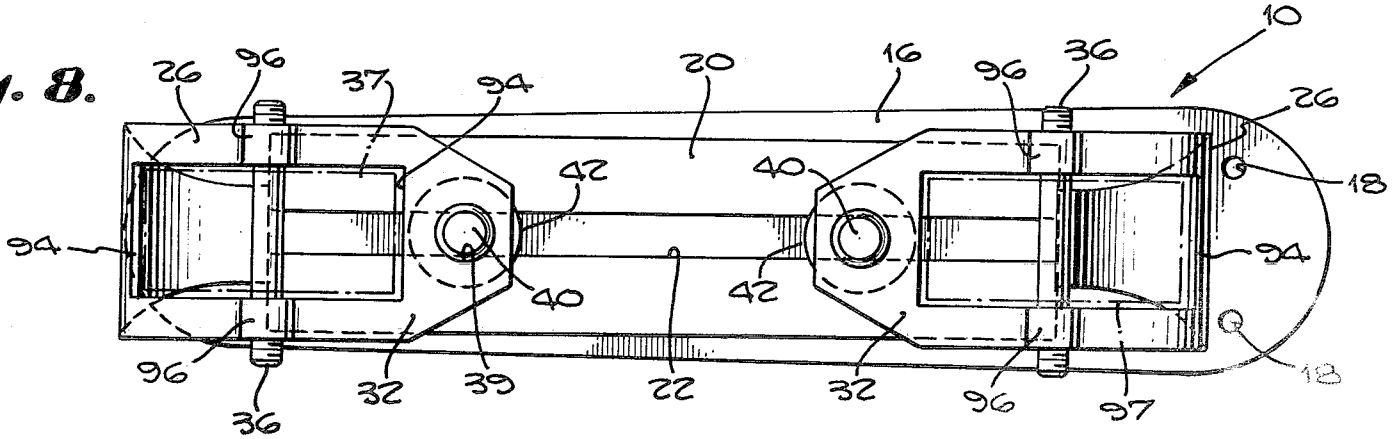
FIG. 8 is bottom view of the embodiment of FIG. 7.

Referring now to FIGS. 7 and 8, another embodiment of the roller skate plate assembly 10 utilizing but two urethane wheels 37 each will be shown. The design of this skate plate 10 is very similar to the design discussed above. Therefore, similar numbers will be used to describe similar parts which will not be described a second time here. The C-shaped leaf springs 26 include second ends 32 which are wider than those of FIG. 3 and which incorporate a rectangular aperture 94 that clears the wheels 37. The pivot post assemblies 42 have been moved closer to the center of the plate 16 within the T-shaped slot 22–24 to clear the single wheels 37 upon the axles 36. The semicircular relief portions 34 within the springs 26 that receive the axles 36 are shorter and reinforced with sleeves 96 which are brazed, as by copper brazing, into the reliefs 34. The sleeves 96 also permit the mounting of the single wheel 37 upon the axle 36 which must slide into each sleeve through the wheel 37. Each axle is retained by nuts, not shown. The semicircular central portions 30 of C-shaped leaf springs 26 are widened to accommodate the apertures 94 and then merged into the flat portions 28 which mount under post assemblies 42. Beyond these differences, the design of the four wheel versus the two wheel skate is very similar.

While the elastomeric plug 57 is shown in FIG. 7, it will be understood that the plug may by used interchangeably with the spring 56 and is generally used by beginners or long distance skaters. It will also be understood that the two wheel skate of the present invention will be used more for trick or figure skating than by a beginner.

The roller skate plate assembly thus described may be adjusted in several areas including: the forward and backward adjustment of pivot post assemblies 42, the adjustment by addding the washers 70 or turning the keepers 72, and the adjustment, by replacement, of the C-shaped leaf springs 26 and/or the helical springs 56 or elastomeric plugs 57. Clearly other adjustments and/or modifications will become apparent to those skilled in the art. Accordingly, the present invention should be limited only by the appended claims.

I claim:

1. A roller skate plate assembly upon which may be mounted a boot and to which is attached a plurality of skate wheels, comprising:

a spring mounting plate;

a pair of C-shaped leaf springs each mounted at one end upon said spring mounting plate;

a pair of axles mounted upon and before the other end of said C-shaped leaf springs for attaching said skate wheels;

a pair of resilient pivots mounted upon said spring mounting plate and engaging said other end of said C-shaped leaf springs;

said pair of resilient pivots each comprising a housing mounted upon said spring mounting plate having a longitudinal bore therein;

resilient members mounted within said longitudinal bores;

pivot plunger means mounted within said bores and retained therein by said C-shaped leaf springs;

wherein said axles float up and down upon said C-shaped leaf springs and said resilient pivots while pivoting about said resilient pivots.

2. A roller skate plate assembly, as claimed in claim 1, wherein:

said spring mounting plate includes a boot plate attached to said boot having a spring mounting platform attached to said boot plate; and said spring mounting platform is slotted along its longitudinal axis parallel to said boot plate for receipt of said C-shaped leaf springs.

3. A roller skate plate assembly, as claimed in claim 2, wherein:

said slot within said spring mounting platform is a T-shaped slot with said pair of resilient pivots mounted in the vertical portion thereof to secure said C-shaped leaf springs horizontally mounted within said T-shaped slot.

4. A roller skate plate assembly, as claimed in claim 3, wherein:

said C-shaped leaf springs and said resilient pivots are adjustably secured within said T-shaped slot.

5. A roller skate plate assembly, as claimed in claim 1, wherein:

said C-shaped leaf springs are identically configured with semicircular detents before said other end into which said axles are mounted.

6. A roller skate plate assembly, as claimed in claim 5, wherein:

said axis are mounted by brazing said axles to said C-shaped leaf springs.

7. A roller skate plate assembly, as claimed in claim 1, wherein said pivot plunger means additionally comprises:

a plunger having a cylindrical portion that slidably engages said bore and a spherical ball portion;

said C-shaped leaf spring having a aperture therein;

a pivot cap slidably engaging said spring aperture having a spherical socket which pivotably engages said spherical ball portion of said plunger and shoulder means against which said leaf spring urges said cap and plunger against said resilient member in said housing.

8. A roller skate plate assembly, as claimed in claim 7, wherein:

said shoulder means includes external threads upon said pivot cap and a retainer nut adjustably mounted thereto which may adjust the compression of said resilient member.

9. A roller skate plate assembly, as claimed in claim 7, wherein:

said shoulder means includes an external extension of the outer surface of said pivot cap and toroidally shaped washer means mounted thereon which may adjust the compression of said resilient member.

10. A roller skate plate assembly, as claimed in claim 1 wherein:

said resilient member is an elastomeric plug.

11. A roller skate plate assembly, as claimed in claim 1, wherein:

said resilient member is a helical compression spring.

12. A roller skate plate assembly, as claimed in claim 1, additionally comprising:

a toe stop mounted upon the front most portion of said plate assembly.

13. A roller skate plate assembly, as claimed in claim 1, additionally comprising:

a jump strap mounted upon said spring mounting plate having two arms each with an aperture therein slidably engaging said resilient pivots to restrain said floating movement of said axles.

14. A roller skate plate assembly, as claimed in claim 1, wherein:

said plurality of skate wheels includes two wheels upon each skate mounted at the center of each floating axle.

15. A roller skate plate assembly, as claimed in claim 1, wherein:

said pluality of skate wheels includes four wheels upon each skate mounted at the ends of each floating axle.

16. A roller skate plate assembly, as claimed in claim 1, wherein:

said plurality of skate wheels include urethane coated wheels which enhance the floating characteristics of said axles.

17. A roller skate plate assembly for mounting a skater's boot and skate wheels, comprising:

a plate for mounting to the sole of said boot having a T-shaped slot extending its full length;

C-shaped leaf springs having one end thereof mounted within said T-shaped slot;

resilient pivot posts mounted upon said plate for adjustably securing said C-shaped leaf springs within said T-shaped slots each including:

a housing having a longtidinal bore mounted within said T-shaped slot to secure said C-shaped spring;

a resilient member slidably mounted within said bore;

a pivot plunger mounted within said bore against the urging of said resilient member, and a pivot cap mounted upon said pivot plunger;

said C-shaped leaf springs having an aperture at the second ends thereof for slidably engaging said pivot caps and retaining said caps and plungers within said housings against the urging of said resilient members; and axles mounted upon said C-shaped leaf springs for receiving said skate wheels.

18. A roller skate plate assembly, as claimed in claim 17 wherein:

said C-shaped leaf springs are each relieved between said ends of said C-shaped leaf spring with semicircular relief to receive said axles which are attached therein by brazing.

19. A roller skate plate assembly, as claimed in claim 17, additionally comprising:

said pivot caps having external threads, and retainer nuts mounted upon said threads between said C-shaped leaf springs and said pivot plungers to adjust the compression of said resilient members and provide a stop for the horizontal motion of said plungers.

20. A roller skate plate assembly, as claimed in claim 17, additionally comprising:

said pivot caps having externally extending shoulders, and toroidally shaped washers mounted between said shoulders and said C-shaped leaf springs to adjust the compression of said resilient members.

21. A roller skate plate assembly, as claimed in claim 17, wherein:

said skate wheels includes two wheels upon each skate mounted at the center of each floating axle.

22. A roller skate plate assembly, as claimed in claim 17, wherein:

said skate wheels includes four wheels upon each skate mounted at the ends of each floating axle.

23. A roller skate plate assembly, as claimed in claim 17, wherein:

said skate wheels include urethane coated wheels which enhance the floating characteristics of said axles.

24. A roller skate plate assembly, as claimed in claim 17, wherein:

said plate includes a spring mounting platform extending from said plate through which said T-shaped slot is longitudinally extended.

25. A roller skate plate assembly, as claimed in claim 17, wherein:

said resilient members are helical springs.

26. A roller skate plate assembly, as claimed in claim 17, wherein:

said resilient members are elastomeric plugs.

27. A roller skate plate assembly for mounting a skater's boot and skate wheels, comprising:

a plate for mounting the sole of said boot having a T-shaped slot extending longitudinally along its length;

C-shaped leaf springs having first ends extending into said T-shaped slot for mounting therein;

pivot posts mounted within said T-shaped slot upon said plate to secure said C-shaped leaf springs within said slot;

said C-shaped springs pivotally engaging said pivot posts at the second ends of said springs; and axles mounted upon said C-shaped springs adjacent said second ends and between said first ends.

28. A roller skate plate assembly, as claimed in claim 27, wherein:

said C-shaped leaf springs are 0.063 inch spring steel; and said wheels are urethane coated.

29. A roller skate plate assembly to which is attached a plurality of skate wheels, comprising:

a spring mounting plate;

a pair of leaf springs each mounted at one end upon said spring mounting plate;

a pair of axles mounted upon and before the other end of said leaf springs for attaching said skate wheels to said spring mounting plate;

a pair of resilient pivots mounted upon said spring mounting plate and engaging said other end of said leaf springs;

said pair of resilient pivots each comprising a housing mounted upon said spring mounting plate having a longitudinal bore therein:

resilient members mounted within said longitudinal bores;

pivot plunger means mounted within said bores against said resilient members and retained therein solely by said leaf springs;

wherein said resilient members may be easily replaced within said longitudinal bores and said axles float up and down upon said leaf srings and said resilient pivots while pivoting about said resilient pivots.

* * * * *